US006786206B2

(12) United States Patent
Koga et al.

(10) Patent No.: US 6,786,206 B2
(45) Date of Patent: Sep. 7, 2004

(54) FUEL PUMP DRIVE SYSTEM

(75) Inventors: Ryuuichi Koga, Tokyo (JP); Hideyuki Ishikawa, Tokyo (JP)

(73) Assignee: Hino Motors, Ltd., Hino (JP)

( * ) Notice: Subject to any disclaimer, the term of this patent is extended or adjusted under 35 U.S.C. 154(b) by 0 days.

(21) Appl. No.: 10/378,899

(22) Filed: Mar. 5, 2003

(65) Prior Publication Data

US 2003/0168048 A1 Sep. 11, 2003

(30) Foreign Application Priority Data

Mar. 6, 2002 (JP) ..... 2002-060424

(51) Int. Cl.[7] ..... F02M 33/04; F16H 55/17
(52) U.S. Cl. ..... 123/495; 123/509; 123/198 C
(58) Field of Search ..... 123/508, 509, 123/495, 198 C; 417/364

(56) References Cited

U.S. PATENT DOCUMENTS 2,512,125 A * 6/1950 Whited ..... 417/238
3,781,137 A * 12/1973 Engstrom ..... 417/360
4,218,193 A * 8/1980 Mehne ..... 417/364
4,305,352 A * 12/1981 Oshima et al. ..... 123/90.15
4,411,237 A * 10/1983 Ableitner et al. ..... 123/501
5,255,643 A * 10/1993 Mochizuki et al. .... 123/179.17
5,511,956 A * 4/1996 Hasegawa et al. ..... 417/271
6,415,758 B1 * 7/2002 Pierro et al. ..... 123/195 R

* cited by examiner

*Primary Examiner*—Thomas N. Moulis
(74) *Attorney, Agent, or Firm*—Oblon, Spivak, McClelland, Maier & Neustadt, P.C.

(57) ABSTRACT

Disclosed is a fuel pump drive system which can change revolution ratio of an engine to a fuel pump to one-to-one without vast increase in cost, allowing the fuel pump to be smaller-sized fuel pump. The system has a conventional flywheel housing with a gear through hole opened to a gear train accommodation space and adapted to receive a conventional input gear as an element of a gear train for transmission of the torque to the fuel pump through meshing with an output gear with revolution ratio of the engine to the fuel pump being two-to-one, an air compressor gear (new input gear) for transmission of the torque to the fuel pump through meshing with a smaller main idle (output gear) via an idle gear within a range of the gear through hole with revolution ratio of the engine to the fuel pump being changed to one-to-one, and an adapter interposed between the flywheel housing and the fuel pump for rotatably supporting the idle gear in a position for meshing with the air compressor gear.

2 Claims, 5 Drawing Sheets

FUEL PUMP DRIVE SYSTEM

BACKGROUND OF THE INVENTION

1. Field of the Invention

The present invention relates to a fuel pump drive system.

2. Description of the Related Art

A common rail type fuel injection system for injection of fuel to an engine has been known as a system which can enhance an injection pressure and which optimally controls injection conditions such as fuel injection rate and timings depending upon operational status of the engine.

FIG. 1 is a block diagram typically and schematically showing such common rail type fuel injection system in which fuel in a fuel tank 1 is pressurized by a fuel pump 2 in the form of for example a plunger type variable displacement high-pressure pump.

This fuel pump 2 is driven by an engine output to pressurize the fuel into a required pressure and deliver the same via a fuel conduit 3 to a common rail 4 where the fuel is accumulated in pressurized state.

The fuel pump 2 is provided with a valve means 5 which controls fuel discharge rate to maintain the fuel in the common rail 4 to a predetermined pressure. Relieved fuel from the pump 2 is returned by a return conduit 6 to the tank 1.

The fuel in the common rail 4 is delivered via delivery conduits 7 to a plurality of injectors 8 each for each cylinder of the engine to inject the fuel into the respective cylinders; part of the fuel delivered via the conduits 7 to the injectors 8 that has failed to be consumed for injection into the cylinders is returned via a return conduit 9 to the tank 1.

Reference numeral 10 denotes an engine-control computer or ECU (electronic control unit) which receives, for detection of operational status of the engine, various signals such as a cylinder discriminating signal 11 from an engine cylinder discriminating sensor, a crank angle signal 12 from a crank angle sensor for sensing phase difference relative to for example a top dead center (TDC), an accelerator opening signal 13 from an accelerator opening sensor (engine load sensor) for sensing a pressurized amount of an accelerator pedal and an engine revolution speed signal 14 from an engine revolution speed sensor.

The common rail 4 is provided with a pressure sensor 15 which detects pressure in the common rail 4. A pressure signal 16 from the sensor 15 is also inputted to the electronic control unit 10.

On the basis of these signals, the electronic control unit 10 issues injection commands 18 to electromagnetic valves 17 of the injectors 8 to optimize the engine output in line with the operational status, thereby optimally controlling fuel injection conditions, i.e., fuel injection rate and timings (injection starting and ending timings).

The pressure in the common rail 4, which may be lowered due to consumption of the fuel in the rail 4 through injection by the injectors 8, is controlled by the electronic control unit 10 to a required fuel injection pressure depending upon the operational status of the engine. More specifically, the unit 10 issues a pressure control command 20 to an electromagnetic valve 19 of the discharge rate control valve means 5 of the fuel pump 2 to control the discharge rate of the fuel pump 2, thereby controlling the pressure in the common rail 4.

Injection starting and ending timings of the fuel are controlled such that phase difference from a predetermined crank angle (for example, that of TDC) is calculated by the crank angle sensor on the basis of which the electronic control unit 10 issues command pulses (the injection commands 18) to establish drive current to the electromagnetic valves 17 of the injectors 8 so as to inject the fuel over a predetermined period in terms of the crank angle signal 12.

In the common rail type fuel injection system thus constructed, the fuel pump 2 is engine driven by torque transmitted from a crankshaft via a gear train with the revolution ratio of the engine to the fuel pump 2 being two-to-one (i.e., two revolutions of the engine per revolution of the fuel pump) as traditional with respect to the timings of the conventional mechanical fuel injection systems; this will needlessly involve increase in capacity of the fuel pump 2 irrespective of the fact that such revolution ratio has no substantive meanings or advantages in the common rail type fuel injection system.

That is to say, in a mechanical fuel injection system where fuel discharge timing of the fuel pump 2 is mechanically made accordant with fuel injection timing for a four cycle engine, the revolution ratio of the engine to the fuel pump must be two-to-one to attain two revolutions of the engine per injection in the respective cylinders whereas such revolution ratio of two-to-one has no specific meanings or needs in a common rail type fuel injection system where the fuel from the fuel pump 2 is accumulated in the common rail 4 in pressurized state and the fuel injection in the respective cylinders is electronically controlled.

In view of the above, the inventors thought of an engine with a common rail type fuel injection system where revolution ratio of the engine to a fuel pump is set to one-to-one, which allows reduced fuel discharge rate per revolution of the fuel pump and thus allows the fuel pump to be smaller-sized, leading to improvement in mountability of the engine to a vehicle.

However, there are problems in this respect. As shown in FIG. 2, in a conventional gear train G for transmission of torque from a crankshaft 21 to the fuel pump 2, rotation or revolution of the crank shaft 21 integral with the crank gear 22 causes a larger main idler 23 in mesh with the gear 22 to rotate integrally with a smaller main idler 24; then, an air compressor gear 25 in mesh with the idler 24 is rotated integrally with a drive shaft 26 which serves to drive not only the fuel pump 2 but also an air compressor 27 (see FIG. 4). Therefore, if the revolution ratio of two-to-one as shown in FIG. 2 is to be changed into one-to-one, then, as shown in FIG. 3, the air compressor gear 25 must be in mesh with the larger main idler 23 having gear teeth twice in number as great as that of the smaller main idler 24, which will involve substantial displacement of an axis of the air compressor gear 25. As a result, a flywheel housing 28 which is to accommodate such gear train G must be inevitably changed in shape, resulting in significant increase in cost.

More specifically, as shown in FIG. 4 with reference to the structure shown in FIG. 2, the flywheel housing 28 is integrally formed with an accommodation space S for the gear train G which is partly defined by a bracket 28*a* of the housing 28. The bracket 28*a* is formed with a gear through hole 29 through which the air compressor gear 25 is passed to the space S with the air compressor 27 being fitted together with the fuel pump 2 to the bracket 28*a*; thus, arrangement of the air compressor gear 25 in a position shown in FIG. 3 utterly away from its original or conventional position will necessitate a new flywheel housing 28 with its gear through hole 29 being formed thereon in a different position. The flywheel housing 28 itself is an expensive and larger-sized part and is of various kinds such that dozens of alternative flywheel housings are usually stocked. Therefore, innovation of such housing with conventional stocks being reserved will lead to vast increase in cost from viewpoints of not only manufacture but also storage.

BRIEF SUMMARY OF THE INVENTION

The present invention was made in view of the above and has its object to set revolution ratio of an engine to a fuel pump to one-to-one without involving vast increase in cost, thereby allowing a fuel pump to be smaller-sized.

The invention is directed to a fuel pump drive system for engine driving a fuel pump by torque transmitted from a crankshaft via a gear train, comprising a conventional flywheel housing with a gear through hole opened to a gear train accommodation space and adapted to receive a conventional input gear as an element of the gear train for transmission of the torque to the fuel pump through meshing with an output gear with revolution ratio of an engine to the fuel pump being set to two-to-one, a new input gear in lieu of said conventional input gear for transmission of the torque to the fuel pump through engagement with said output gear via an idle gear within a range of said gear through hole with revolution ratio of the engine to the fuel pump being changed to one-to-one, and an adapter interposed between said flywheel housing and said fuel pump for rotatably supporting said idle gear in a position for meshing with said new input gear.

Thus, use of the existing or conventional flywheel housing with the gear through hole for receiving the gear train with revolution ratio of the engine to the fuel pump of two-to-one, without changing the design of the flywheel housing and together with the new input gear and the idle gear which are receivable in the gear through hole of the existing flywheel housing, can change revolution ratio of the engine to the fuel pump to one-to-one, which allows a reduced fuel discharge rate per revolution of the fuel pump, thereby allowing the fuel pump to be smaller-sized.

Moreover, in the invention, an air compressor may be arranged between the adapter and fuel pump, both the fuel pump and the air compressor being driven by a drive shaft. This allows, in a vessel with the air compressor being arranged between the adapter and fuel pump, the air compressor to be also driven with revolution ratio of one-to-one with respect to the engine, so that necessary air compression work can be attained by the air compressor which is smaller in capacity than the conventional ones, leading to allowance of the air compressor to be smaller-sized.

A preferred embodiment of the invention will be described in conjunction with the drawings.

DETAILED DESCRIPTION OF THE PREFERRED EMBODIMENT

Figure 1:
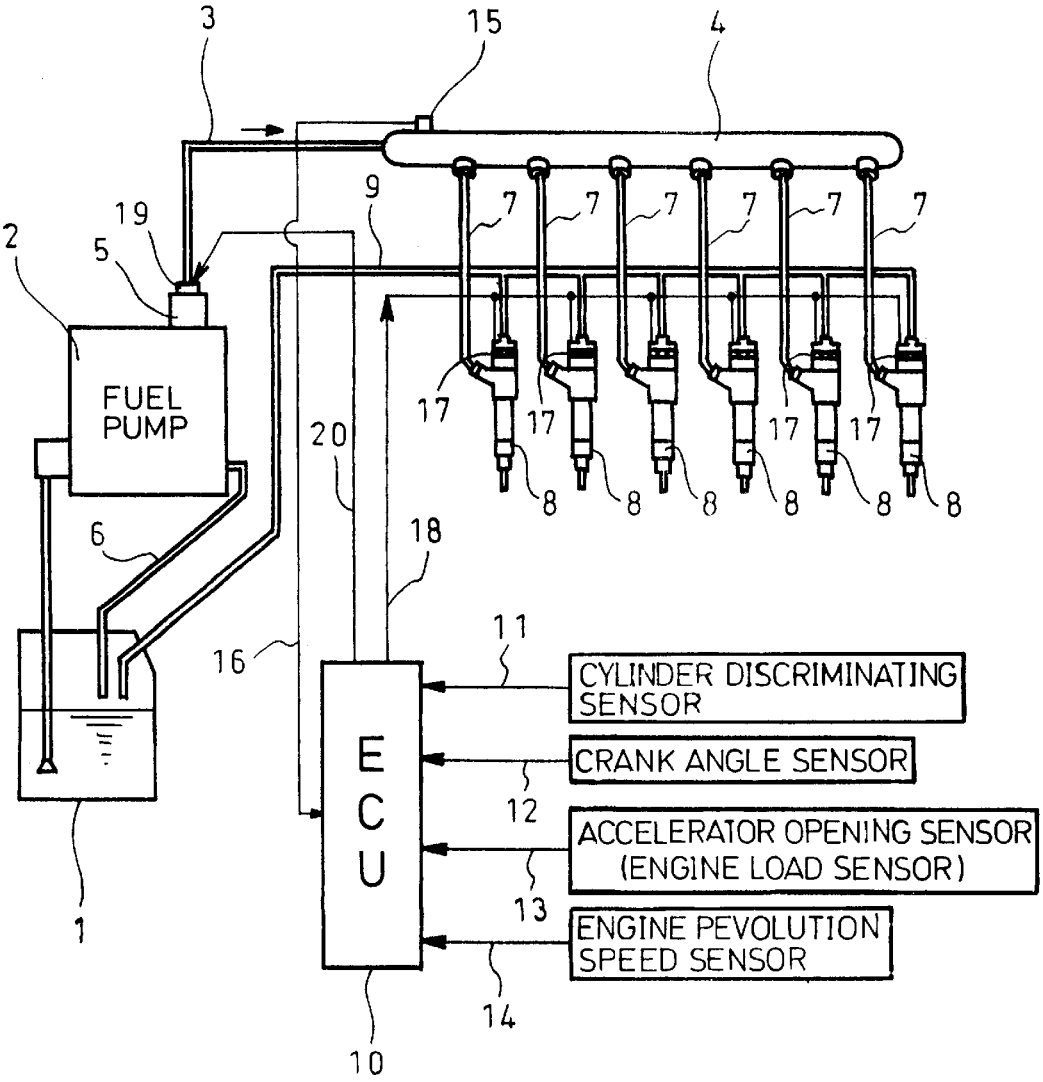
FIG. 1 RELATED ART
FIG. 1 is a block diagram for schematically showing a conventional common rail type fuel injection system.
Figure 2:
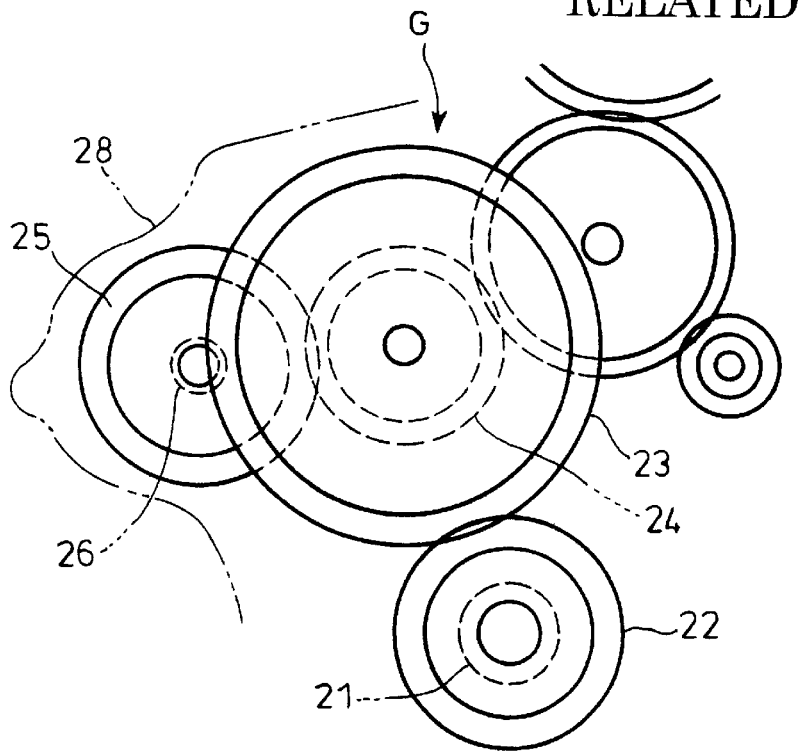
FIG. 2 RELATED ART
FIG. 2 is a front view of a conventional gear train with revolution ratio of an engine to a fuel pump being two-to-one.
Figure 3:
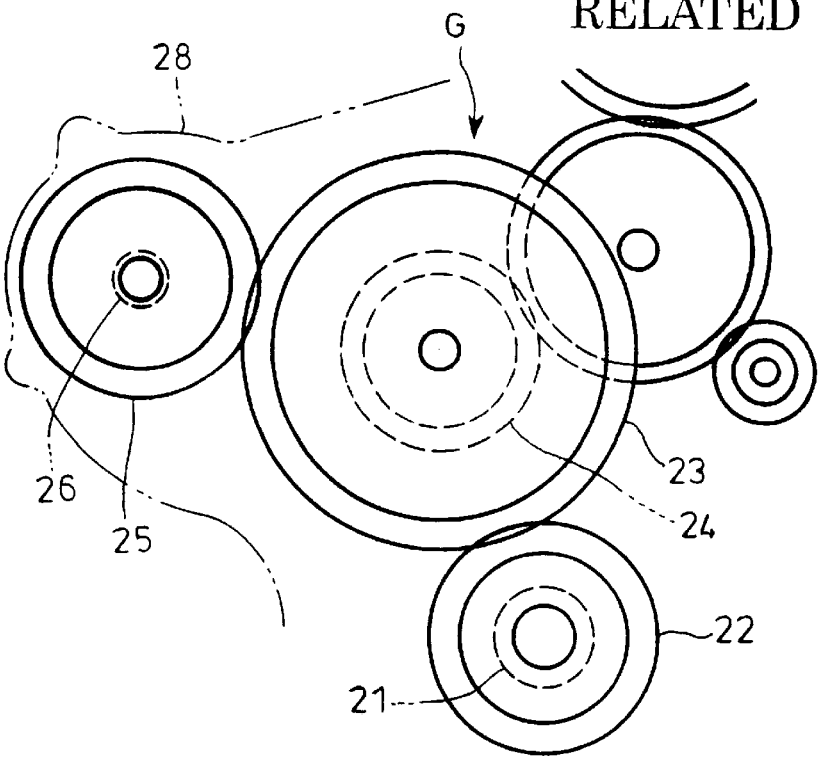
FIG. 3 RELATED ART
FIG. 3 is a front view of the gear train shown in FIG. 2 with revolution ratio being changed to one-to-one.
Figure 4:
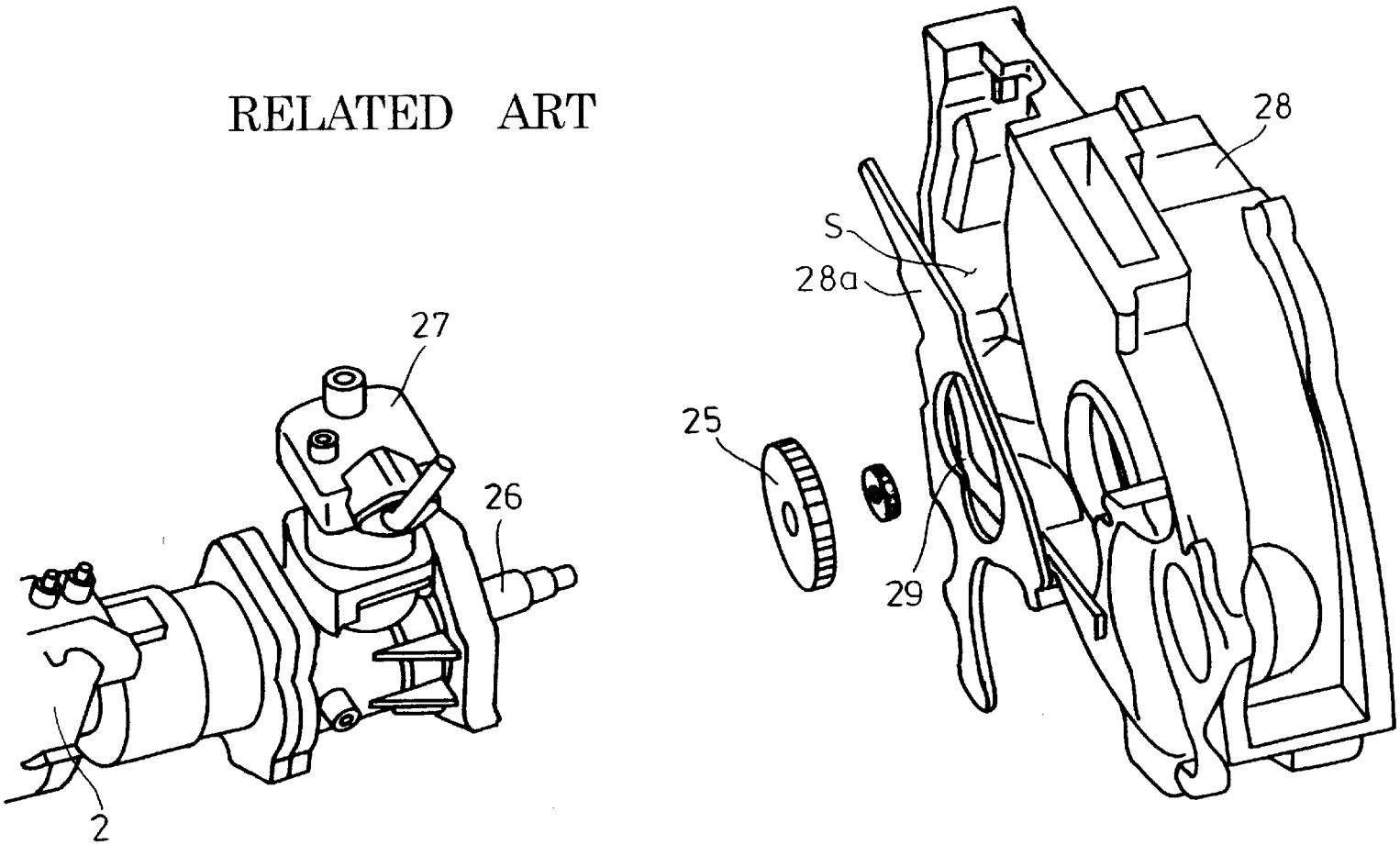
FIG. 4 RELATED ART
FIG. 4 is a perspective view of the conventional structure shown in FIG. 2.
Figure 5:
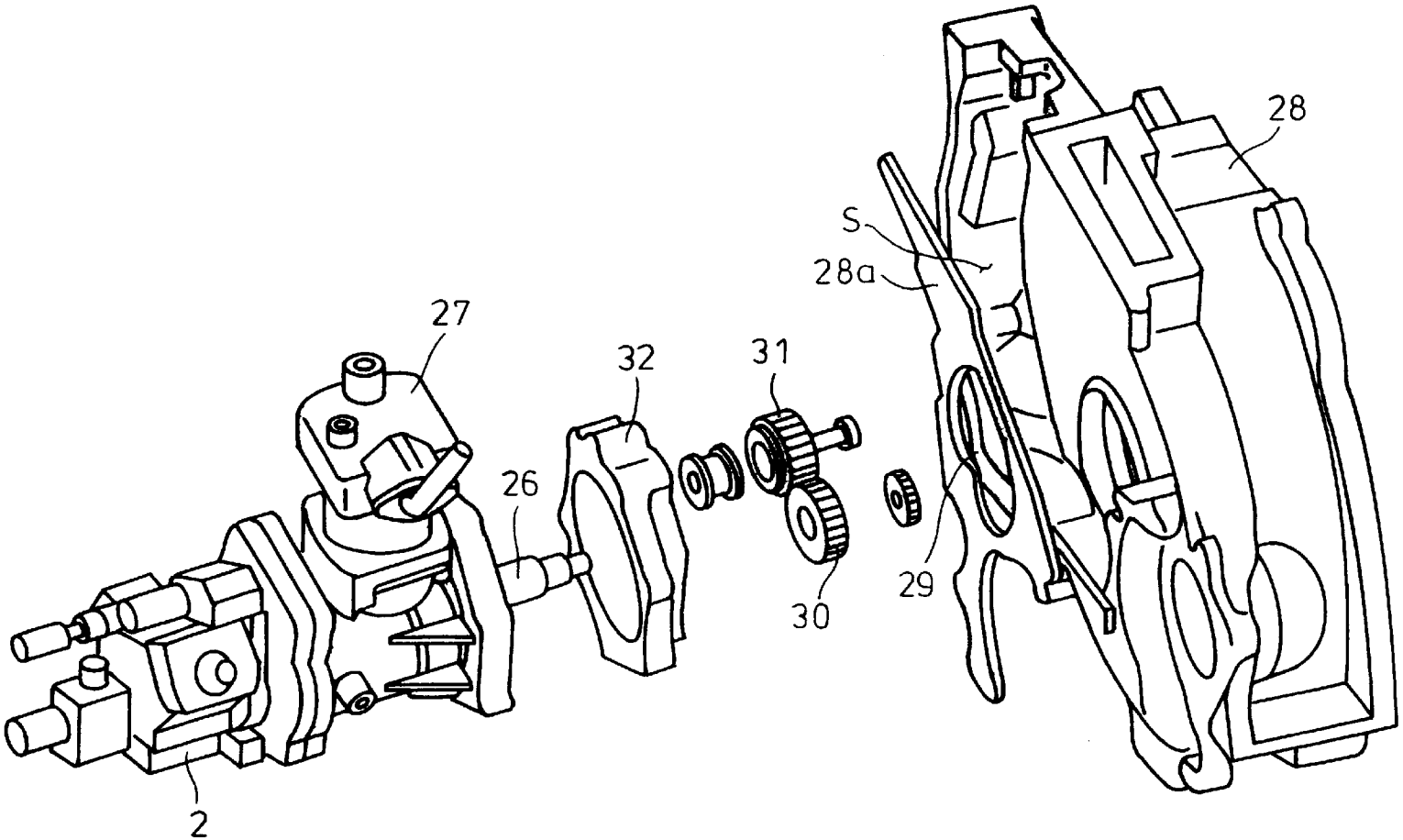
FIG. 5 is a perspective view showing an embodiment of the invention.
Figure 6:
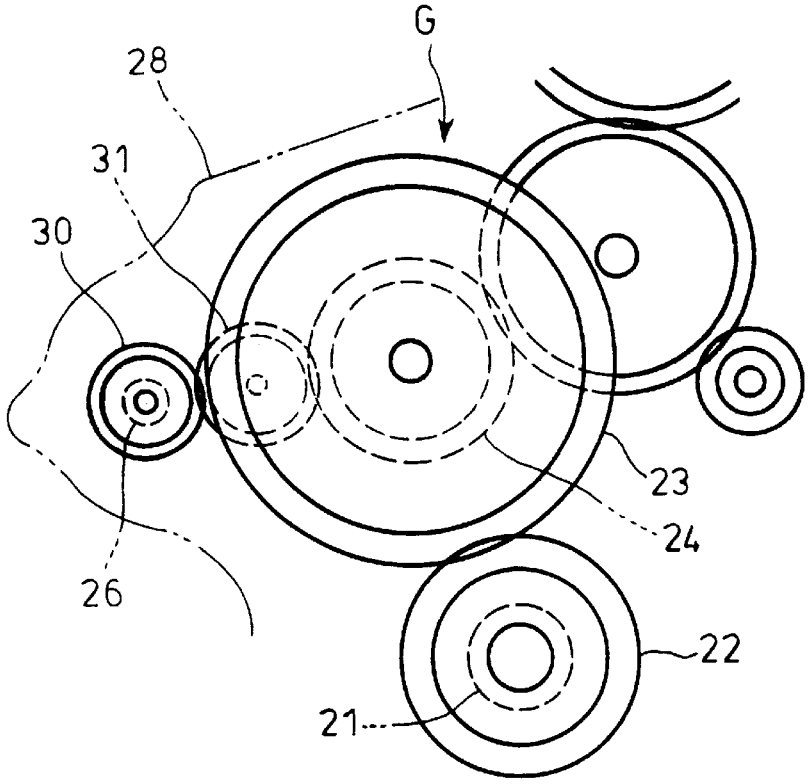
FIG. 6 is a front view showing the gear train in the embodiment.
Figure 7:
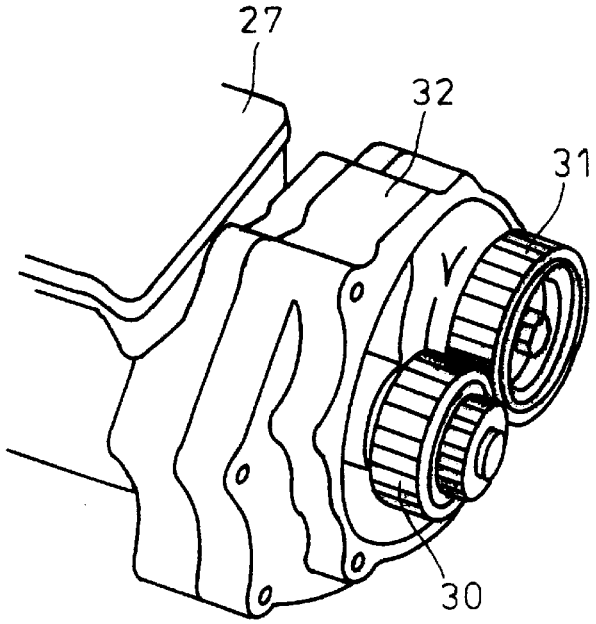
FIG. 7 is a perspective view showing in details the adapter of FIG. 5.

FIGS. 5–7 show an embodiment of the invention in which any parts similar to those in FIGS. 1–4 are designated by the same reference numerals.

As shown, in the embodiment, an air compressor gear 25 (a conventional input gear: see FIGS. 2 and 4) used for revolution ratio of the engine to the fuel pump 2 of two-to-one is replaced with an air compressor gear 30 (a new or substitutive input gear) which has a radius and gear teeth substantially half as great as those of the conventional input gear. As is conventional, concentrically connected to this air compressor gear 30 is a fuel pump 2. More specifically, both the fuel pump 2 and the air compressor 27 are driven in unison by a drive shaft 26 rotated integrally with the air compressor gear 30.

The new air compressor gear 30 is received together with an idle gear 31 within a range of a gear through hole 29 of a conventional or existing flywheel housing 28 which has been designed for a gear train G for revolution ratio of the engine to the fuel pump 2 of two-to-one, the hole 29 being originally opened for reception of the conventional air compressor gear 25. Through this idle gear 31, a smaller main idler 24 (output gear) is engaged with the air compressor gear 30 so that torque is transmitted to the fuel pump 2 with the revolution ratio of the engine to the fuel pump 2 being changed to one-to-one.

The idle gear 31 in mesh with the air compressor gear 30 is rotatably supported by an adapter 32 interposed between the flywheel housing 28 and the air compressor 27.

This adapter 32 is fitted to the flywheel housing 28 to which the air compressor 27 has been fitted, such that the idle gear 31 is properly positioned to mesh with the smaller main idler 24.

Thus, in this way, without design-changing the existing flywheel housing 28 designed for the gear train G with revolution ratio of the engine to the fuel pump 2 being two-to-one, the new air compressor gear 30 and idle gear 31 receivable in the range of the gear through hole adapted to originally receive the conventional air compressor gear 25 (see FIGS. 2 and 4) enable revolution ratio of the engine to the fuel pump 2 to be changed into one-to-one, which will reduce fuel discharge rate per revolution of the fuel pump, allowing the fuel pump 2 to be smaller-sized.

Therefore, according to the above embodiment, without design-changing the existing flywheel housing 28, revolution ratio of the engine to the fuel pump 2 can be changed into one-to-one, which allows the fuel pump 2 to be smaller-sized; thus, with respect to an engine with the common rail type fuel injection system applied, mountability of the engine to a vehicle can be drastically improved without vast increase in cost.

Moreover, especially in this embodiment, the fuel pump 2 and the air compressor 27 interposed between the adapter 32 and the fuel pump 2 are driven by one and the same drive shaft 26 so that the air compressor 27 can be also driven with the revolution ratio with respect to the engine being one-to-one. As a result, necessary air compression work can be effected by the air compressor 27 which is smaller in capacity than the conventional ones, allowing the air compressor 27 to be smaller-sized.

It is to be understood that the invention is not limited to the above embodiment and that various changes and modifications may be made without departing from the spirit and scope of the invention.

What is claimed is:

1. A fuel pump drive system for engine driving a fuel pump by torque transmitted from a crankshaft via a gear train, comprising a conventional flywheel housing with a gear through hole opened to a gear train accommodation space and adapted to receive a conventional input gear as an element of the gear train for transmission of the torque to the fuel pump through meshing with an output gear with revolution ratio of an engine to the fuel pump being set to two-to-one, a new input gear in lieu of said conventional input gear for transmission of the torque to the fuel pump through engagement with said output gear via an idle gear within a range of said gear through hole with revolution ratio of the engine to the fuel pump being changed to one-to-one, and an adapter interposed between said flywheel housing and said fuel pump for rotatably supporting said idle gear in a position for meshing with said new input gear.

2. The system according to claim 1 wherein an air compressor is interposed between the adapter and the fuel pump, said air compressor and said fuel pump being driven by a drive shaft.

* * * * *